US012133560B2

(12) United States Patent
Padgett

(10) Patent No.: US 12,133,560 B2
(45) Date of Patent: Nov. 5, 2024

(54) CUSTOM COMPOSITE UNDERWEAR

(71) Applicant: Farideh Etemadi Padgett, Los Angeles, CA (US)

(72) Inventor: Farideh Etemadi Padgett, Los Angeles, CA (US)

( * ) Notice: Subject to any disclaimer, the term of this patent is extended or adjusted under 35 U.S.C. 154(b) by 103 days.

(21) Appl. No.: 17/743,382

(22) Filed: May 12, 2022

(65) Prior Publication Data

US 2022/0361591 A1 Nov. 17, 2022

Related U.S. Application Data

(60) Provisional application No. 63/187,791, filed on May 12, 2021.

(51) Int. Cl.

| | |
|---|---|
| ***A41B 9/00*** | (2006.01) |
| ***A41B 9/14*** | (2006.01) |
| ***A41F 9/00*** | (2006.01) |

(52) U.S. Cl.

CPC ..... *A41B 9/002* (2013.01); *A41B 9/005* (2013.01); *A41B 9/14* (2013.01); *A41F 9/007* (2013.01)

(58) Field of Classification Search

CPC ..... A41B 9/002; A41B 9/005; A41B 9/14; A41B 9/023; A41B 9/026

See application file for complete search history.

(56) References Cited

U.S. PATENT DOCUMENTS 1,107,303 A * 8/1914 Henderson ..... A41D 15/00 2/70
1,504,249 A * 8/1924 Klein ..... A41D 7/00 D2/737
1,531,984 A * 3/1925 Schlissel ..... A41D 1/00 2/70
2,022,621 A * 11/1935 Ide ..... A41D 7/00 2/70
2,034,312 A * 3/1936 Rubin ..... A41D 1/06 2/404
2,641,764 A * 6/1953 Fischer ..... A41B 13/00 D2/776
4,139,913 A * 2/1979 Garin ..... A41F 9/025 2/221
4,561,121 A * 12/1985 Ehring ..... A41D 13/00 2/458
4,580,298 A * 4/1986 Tuisl ..... A41F 9/025 2/338
4,959,876 A * 10/1990 Kalaam ..... A62B 17/003 2/81

(Continued)

*Primary Examiner* — Khaled Annis

(57) ABSTRACT

A two piece, composite men's underwear garment. In a preferred embodiment, boxer briefs, briefs are comprised of a first, outer layer and a second, inner layer. The first, outer layer covers the back area and thighs, and is as long as required or desired, while the crotch area is open, and is attachable to the inner-layer through the waistband, typically using a belt passing through the waist band, which may have one or more openings to assist in attachment. The second, inner layer is similar to a jockstrap covering a crotch area and attached to the outer-layer's waistband using a belt. In an alternative embodiment the boxers can be replaced with a brief, or other style first, outer layer. Additionally, the waist band of the first, outer layer can be comprised of one or more buttons enabling the adjusting the first, outer layer between three different sizes.

12 Claims, 11 Drawing Sheets

(56) References Cited

U.S. PATENT DOCUMENTS

| | | | | |
|---|---|---|---|---|
| 5,163,184 | A * | 11/1992 | Reardon | A41F 9/02 2/218 |
| 6,389,600 | B1 * | 5/2002 | Di Maio | A41D 13/0015 2/121 |
| 9,015,867 | B2 * | 4/2015 | Kenney | A41D 13/0017 2/229 |
| 9,204,676 | B2 * | 12/2015 | Gbadamosi | A41D 27/201 |
| 10,806,200 | B2 * | 10/2020 | Park | A41D 1/08 |
| 11,134,733 | B2 * | 10/2021 | Miller | A41D 1/06 |
| 2004/0200081 | A1 * | 10/2004 | Fujikuma | A41H 1/10 33/2 R |
| 2012/0090076 | A1 * | 4/2012 | Kenney | A41D 15/02 2/211 |
| 2013/0046259 | A1 * | 2/2013 | Mokrane | A41B 9/023 604/349 |
| 2014/0026295 | A1 * | 1/2014 | McIntyre | A41B 9/02 2/403 |
| 2019/0223529 | A1 * | 7/2019 | Park | A41B 1/08 |
| 2022/0361591 | A1 * | 11/2022 | Padgett | A41F 9/007 |

* cited by examiner

CUSTOM COMPOSITE UNDERWEAR

TECHNICAL FIELD OF THE PRESENT INVENTION

The present invention relates to men's underwear. More specifically, the present invention relates to providing custom men's underwear having composite inner and outer components.

BACKGROUND OF THE PRESENT INVENTION

Currently men's underwear in the global market is created only in one piece and their sizes are determined mostly based on waist size only. The reason for this limitation to minimal size offerings based on waist size is that it is extremely difficult to produce all the permutations/combinations required in the market. It is extremely hard to customize this piece of clothing, as wearers are generally unique with different sizes in all different areas including waist, hips, thighs, buttocks, and crotch.

For example, in just one combination of these variations, a waistband could be size "M", while the crotch is XL, thighs are 2XL, and hips are L, causing tightness in the pouch area if the person selects size M, looseness in the waistband if they select XL, or being too large if they select 2XL to prevent riding up.

In order to address all sizes mentioned above, about 3125 combinations are needed. Thus, manufacturers find it cost prohibitive to produce 3125 different sizes for even one fabric color. This is why manufacturers or brands are not able to solve the problem and have chosen to design strange and complicated designs in the pouch area, creating more complications that provide minimal solutions. Even if a manufacturer undertook the expense to create a massive inventory, they are still left with another series of problems mentioned below since their underwear product would all still be a one piece design.

In an effort to provide a wider range of variations in size, some brands add hip as well in their size chart. While a few brands have additionally worked on the "design" of the pouch area, they have ignored the pouch size issue, which is the main issue for men's comfort, and these designs have thus resulted in additional complications and issues after not resolving any of the original issues, creating an even more uncomfortable and inadequate version of men's underwear.

In addition to the above-mentioned body areas where each has its own effects on the level of comfort for men's underwear, another measurement which creates problems is the thigh area; which has been ignored altogether throughout the history of men's underwear. Thighs are one of the most critical reasons that men's underwear, and in particular a men's boxer brief, rides up on the wearer, especially in athletics, where the athletic activity builds the thighs' muscles, filling them with blood and they get larger than normal during athletic activity.

When a man, or wearer of boxer briefs walks, runs, moves, or does activities, the wearer's thigh muscles again get larger and pull the fabric up from the only opening area, which is below them, the legs holes, as there is no other relief or opening above them; and so, creates one of the most popular problems in male underwear in all brands, riding up. Riding up causes pain, irritations, skin problems and requires constant adjustments.

Although there are some complicated designs claiming to solve the problems, because of the main issue mentioned, that being based on a one piece design, they all fail to resolve the above issues and while potentially providing minor success only, they end up creating new issues.

Therefore, what is needed is a new design of men's boxer briefs that resolves sizing issues, support issues, riding up, rubbing, or chaffing, heating up and sweating, pinching, and other issues by providing a men's underwear design that accommodates athletic activity and provides a custom fit.

SUMMARY OF THE INVENTION

The present invention is a two-piece, composite men's underwear garment. In a first embodiment, boxer briefs are comprised of a first, outer layer and a second, inner layer. The first, outer layer covers the back area and thighs, and is as long as required or desired, while the crotch area is open, and is attachable to the inner layer through the waistband, typically using a belt passing through the waist band, which may have one or more openings to assist in attachment.

The second, inner-layer is similar to a jockstrap, covering a crotch area and attached to the outer-layer's waistband. The second, inner layer can be any type of underwear such as a jockstrap, thong, etc. The cut, shape, or design of the second, inner layer can be of any shape as long as the decoupling or separation provided by the pattern/cut is retained. The second, inner layer creates a front pouch as defined by the cut/shape, which is separated or decoupled from the first, outer layer and its flaps which create an opening or access area where the pouch the second, inner layer is located.

Additionally, it is not important what kind or design the straps have, it is important that this underwear is made of two pieces, creating free movements and it is sizably matched and attached to each other.

In a second embodiment the boxers can be replaced with a brief style first, outer layer. Additionally, a back support, covering the back, with zero interaction with the crotch, can be used in a brief style embodiment.

LIST OF REFERENCE CHARACTERS

Item No. Description

10 Waist Band
11 First, Outer Layer for boxer brief
12 Second, Inner Layer
13 Second, Inner Layer Flaps
14 Head Belt
15 Waist Band Openings
16 Waist Band Belt
17 Straps
18 Pouch Belt Holes of the Second, Inner Layer
19 Button Tops
20 Button Bottoms
21 First, Outer Layer for brief
22 Straps for brief, second embodiment, attached to from the bottom of first, outer layer 21 to the front of the waistband in order to keep the back of 21 in place and not movable.

BRIEF DESCRIPTION OF THE DRAWINGS

The accompanying drawings, which are incorporated herein form a part of the specification, illustrate the present invention and, together with the description, further explain the principles of the present invention and to enable a person skilled in the pertinent art to make and use the present invention.

DETAILED DESCRIPTION OF THE PRESENT INVENTION

Figure 1:
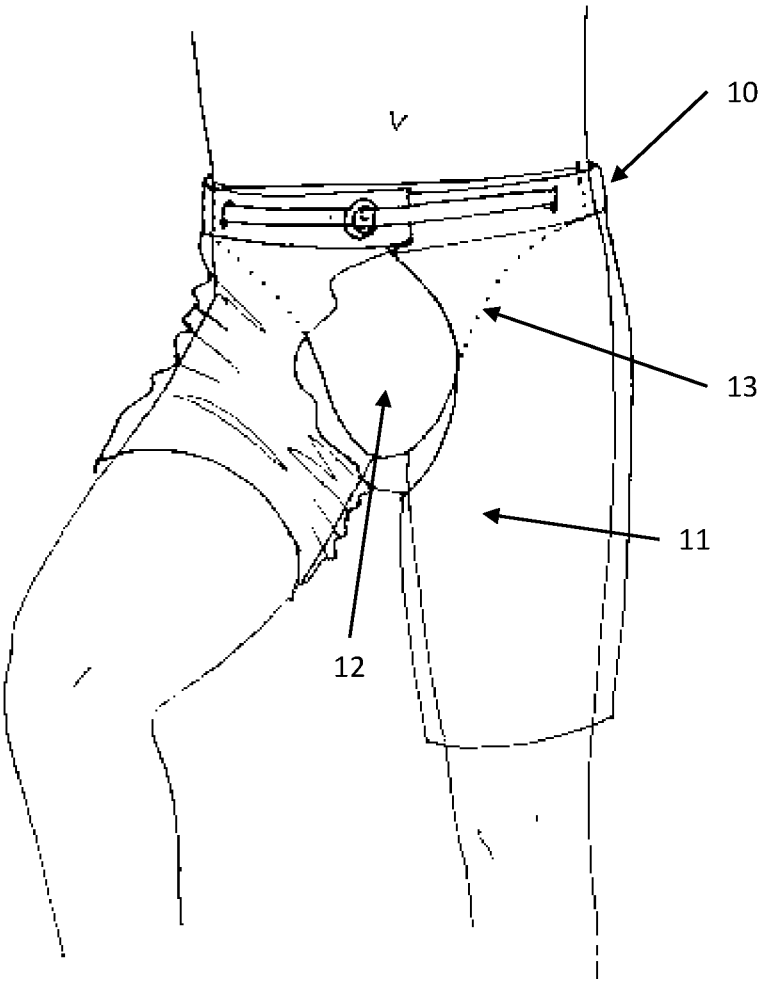
FIG. 1 is a front view of a first embodiment of the present invention as shown being worn and by movement shows that inner layer does not get effected and stays in place.

In the following detailed description of the present invention of exemplary embodiments of the present invention, reference is made to the accompanying drawings (where like numbers represent like elements), which form a part hereof, and in which is shown by way of illustration specific exemplary embodiments in which the present invention is practiced. These embodiments are described in sufficient detail to enable those skilled in the art to practice the present invention, but other embodiments are utilized, and other changes are made without departing from the scope of the present invention. The following detailed description is, therefore, not to be taken in a limiting sense, and the scope of the present invention is defined only by the appended claims.

In the following description, numerous specific details are set forth to provide a thorough understanding of the present invention. However, it is understood that the present invention is practiced without these specific details. In other instances, well-known structures and techniques known to one of ordinary skill in the art have not been shown in detail in order not to obscure the present invention.

The present invention can be utilized in any type of men underwear and/or short, such as boxer brief, brief, boxer, sport short, and short in general, with two specific characteristics. The first characteristic is that it is made from two separate layers. A first layer covers the waist, hips, and thighs (the first layer may also be referred to as the 'outer layer") and a second layer holds and covers the pouch, (the second layer may also be referred to as the 'inner layer") while the layers are completely separate, the layers are preferably attachable from a waistband, or they can also be used separately. Therefore, the engagements between the thighs, hips and pouch are removed all together.

The design of the present invention allows free body movement without engaging the fabric with the hips and thighs with the pouch area, while covering all the areas in any desired length for the boxer brief, such as trunk, mid-way boxer brief or even longer length boxer brief. This design thus eliminates the previous discussed issues as the outer layer and inner layer are decoupled from each other, which eliminates: Riding up, Rubbing/chafing, Zero support, Not being able to select right sizes, Male fertility, and Skin problems.

The pouch area is not closed on the outer layer, it is open completely, thereby creating an open area in the front for cooling off, drying any sweating, and ventilating. Thus, because of the engagement of the hips, pouch, and thighs; this opening and decoupling provide a great relief to the wearer. Therefore, the pouch will not be left in one closed, tight, not enough room, and non-breathable place with other part of the body, hips, and thighs. Therefore, rubbing the skin, pulling public hair, sweating, and pinching, are all eliminated. The resulting pouch area of the present invention is not too loose causing hanging, bouncing with no support, and not keeping the package in its place; requiring constant adjustment. Because of the front opening and decoupling creation, the present invention provides maximum possible comfort for daily activities and body movements such as running, walking, exercising and all other activities, providing maximum flexibility for fabric to open without pulling, riding up, or pinching the pouch area while providing ventilation and cooling.

The second, inner layer 12 is attached to the first, outer layer 11 via the belt 16 and it is adjustable. The first, outer layer 11 fits a wearer like boxer briefs but has no front pouch, allowing to size this layer based on the thigh's measurement, with three optional waist measurements by having three buttons consisting of a button bottoms 20 and corresponding button tops 19.

The second, inner layer 12 provides the pouch area 12, which is decoupled or separated from the outer layer 11 as the only attachment location is in the waist band 10 of the outer layer 11 with the holes 15 and holes 18 of the pouch, inner layer 12.

FIG. 1 is a front view of a first embodiment of the present invention as shown being worn. In this view, we can see the present invention as worn, where the waist band 10 is attached to the first, outer layer 11 and the second, inner layer 12 is decoupled from the first, outer layer 11.

Figure 2:
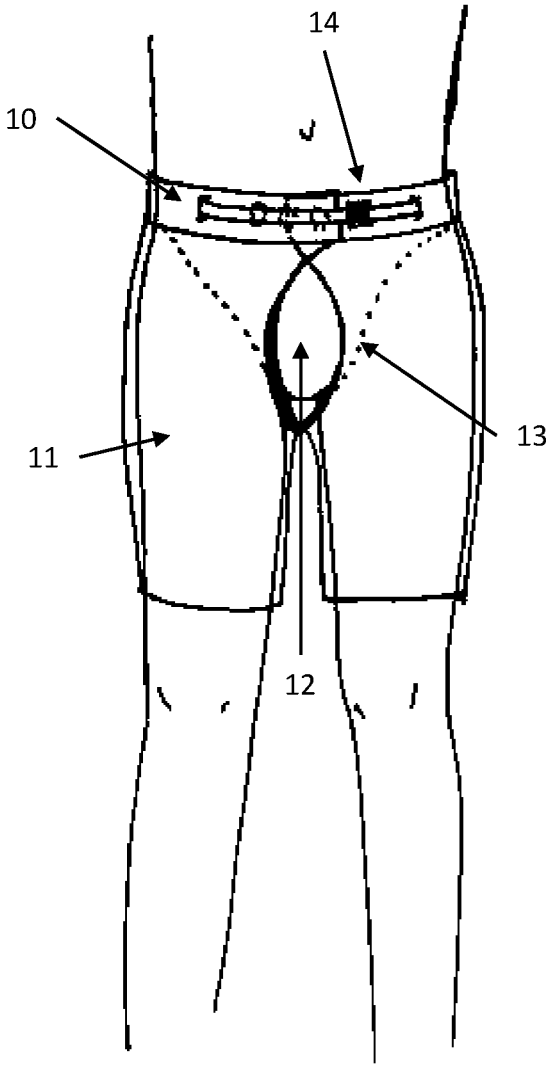
FIG. 2 is a front planar view of a first embodiment of the present invention.

FIG. 2 is a front planar view of a first embodiment of the present invention.

Figure 3:
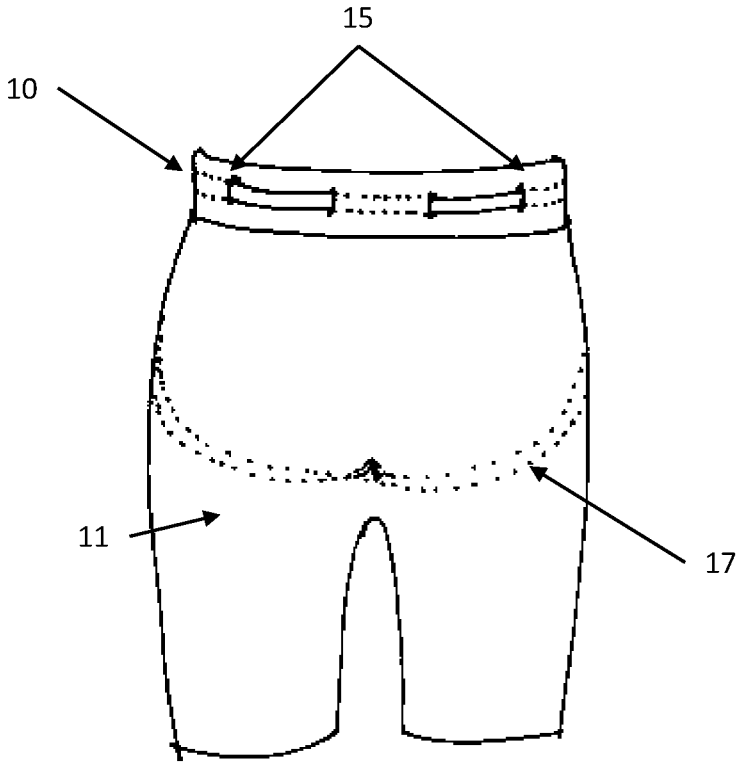
FIG. 3 is a rear planar view of a first embodiment of the present invention.

FIG. 3 is a rear planar view of a first embodiment of the present invention.

Now referring to FIGS. 2 and 3, a first embodiment of the present invention consists of two layers/pieces; a first, outer layer 11 and a second, inner layer 12. Regardless of details such as fly, extra cuts or lines, accessories such as buttons, VELCRO, etc. The present invention can have a fly or not, a padding or not, buttons or VELCRO® (also known as hook and loop) or none of those. These details or decorations are not to be considered as the only solutions or requirements parts of the present invention.

For example, the present invention can have any type or form of buttons, and any type of head belt. The present invention is directed to the decoupling or separation provided by the pattern cut of these two areas/layers which then provides the functionality of making all free body movements possible, without causing all the above issues noted as deficiencies in the prior art devices.

Figure 11:
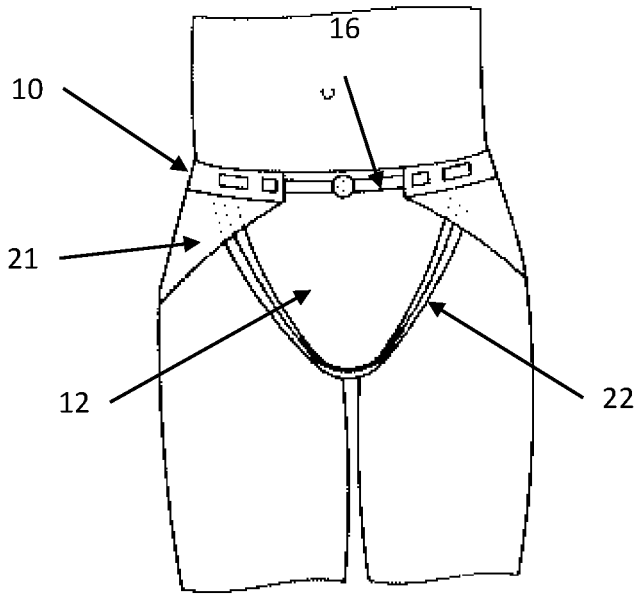
FIG. 11 is a front view of a second embodiment of the present invention, comprising a brief underwear, first outer layer 21, as shown being worn looking through the first, outer layer 21 and highlighting the second, inner layer 12.
Figure 12:
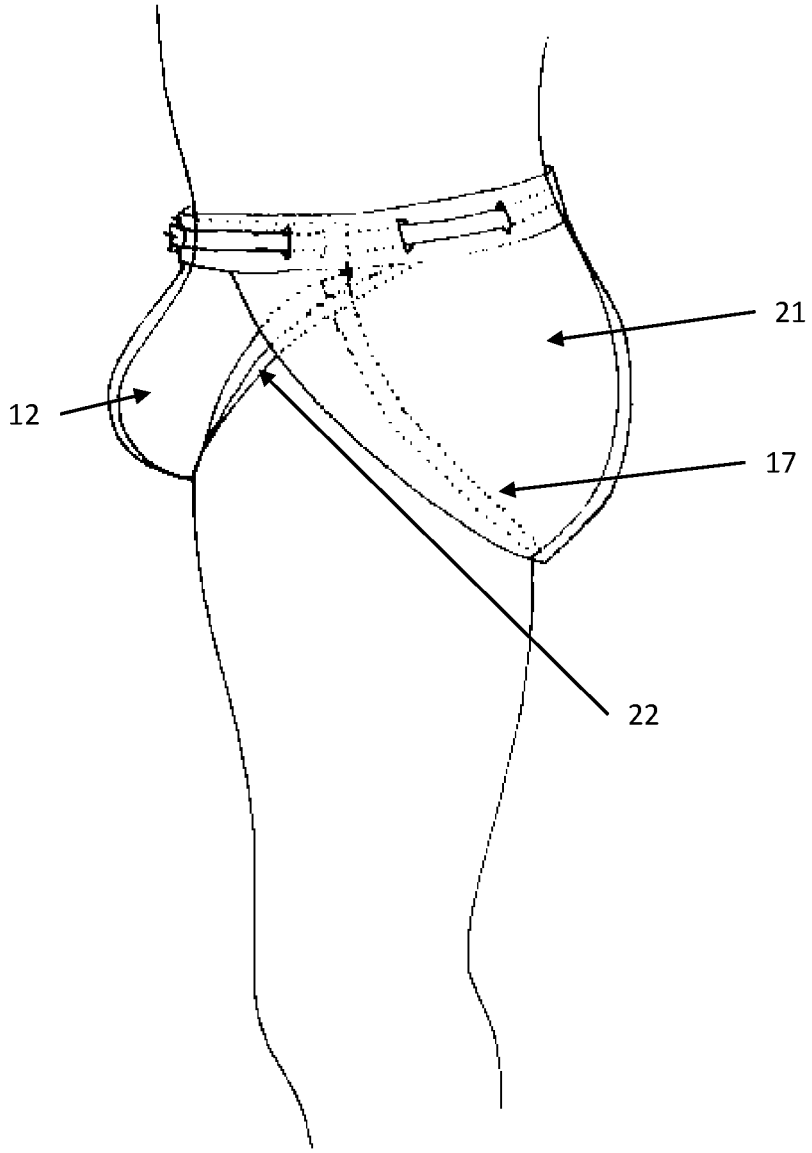
FIG. 12 is a side view of a second embodiment of the present invention comprising a brief underwear first outer layer 21, as shown being worn looking through the first, outer layer 21 and highlighting the second, inner layer 12.
Figure 13C:
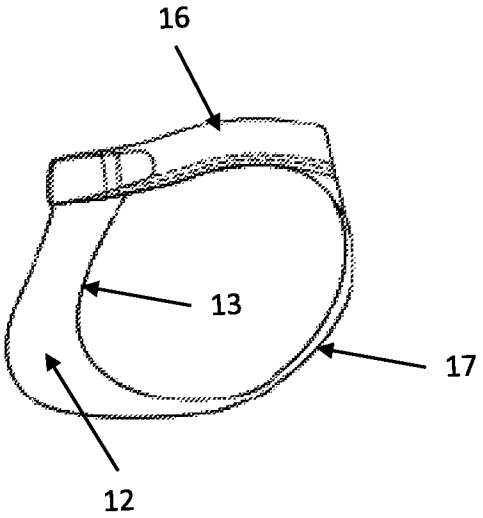
FIGS. 13*a*, 13*b*, and 13*c* are front, back, and side planar views of a thong instead of a jockstrap for the second, inner layer of the present invention, which can be utilized for both embodiments.
Figure 13B:
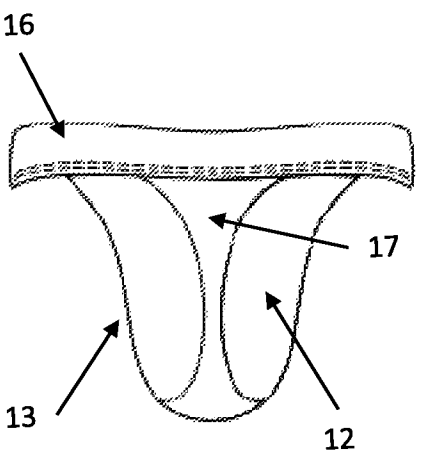
Figure 13A:
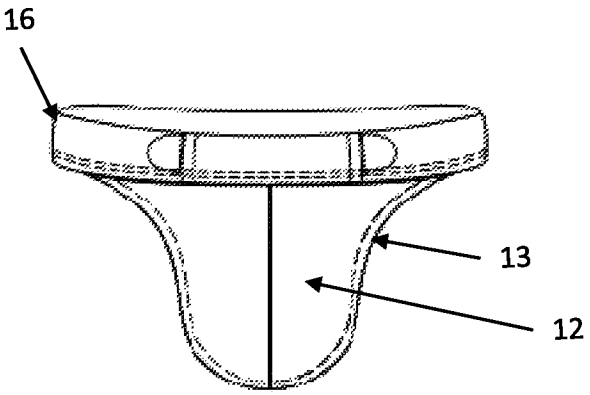

The second, inner layer 12 can be any type of underwear such as a thong as illustrated in FIGS. 13*a*, 13*b*, and 13*c*, or jockstrap, which jockstrap is shown as one exemplary embodiment in FIGS. 1-12. The cut, shape, or design of the second, inner layer can be of any shape as long as the decoupling or separation provided by the pattern/cut is retained. The second, inner layer 12 creates a front pouch 12 as defined by the cut/shape 13, which is separated or decoupled from the first, outer layer 11 and its cut/shape 13 which create an opening or access area where the pouch 12 of the second, inner layer 12 is located.

Referring to the thong selection instead of jockstrap, FIGS. 13*a*, 13*b*, and 13*c*, which in this the second, inner layer 12 also has the pouch defined by the cut/shape 13 same as in jockstrap, but with a single, strap 17 in the middle of the rear of this second, inner layer, in order to connect the pouch section of the second, inner layer to the waist band.

As shown in FIG. 3, it is not important what kind or design the straps 17 have, it is important that this underwear is made of two separate pieces which are attached to each other in the waistband area only, (removable and can be used also separately as two underwear). Thus, creating free body movements, allowing to have custom sizing for each body part (explained in above), in addition to the front opening providing ventilating. FIGS. 1-12 are again of a jockstrap, but a person of ordinary skill in the art (POSITA) would not require illustrates of all possible shapes or cuts to the first, outer layer 11 and/or 21, second, inner layer 12, or any other strap 17 types.

Similarly, any belt, waist band, and any head belt 14 design or type can be used in the present invention. In the Figures, a standard belt 16 is illustrated where the head belt 14 and band has a plurality of types and designs as illustrated. A belt 16, stretch band, or other similar apparatus can be used to provide an adjustable waist band in the present invention and as a means to connect the first, outer layer 11 to the second, inner layer 12.

Figure 4:
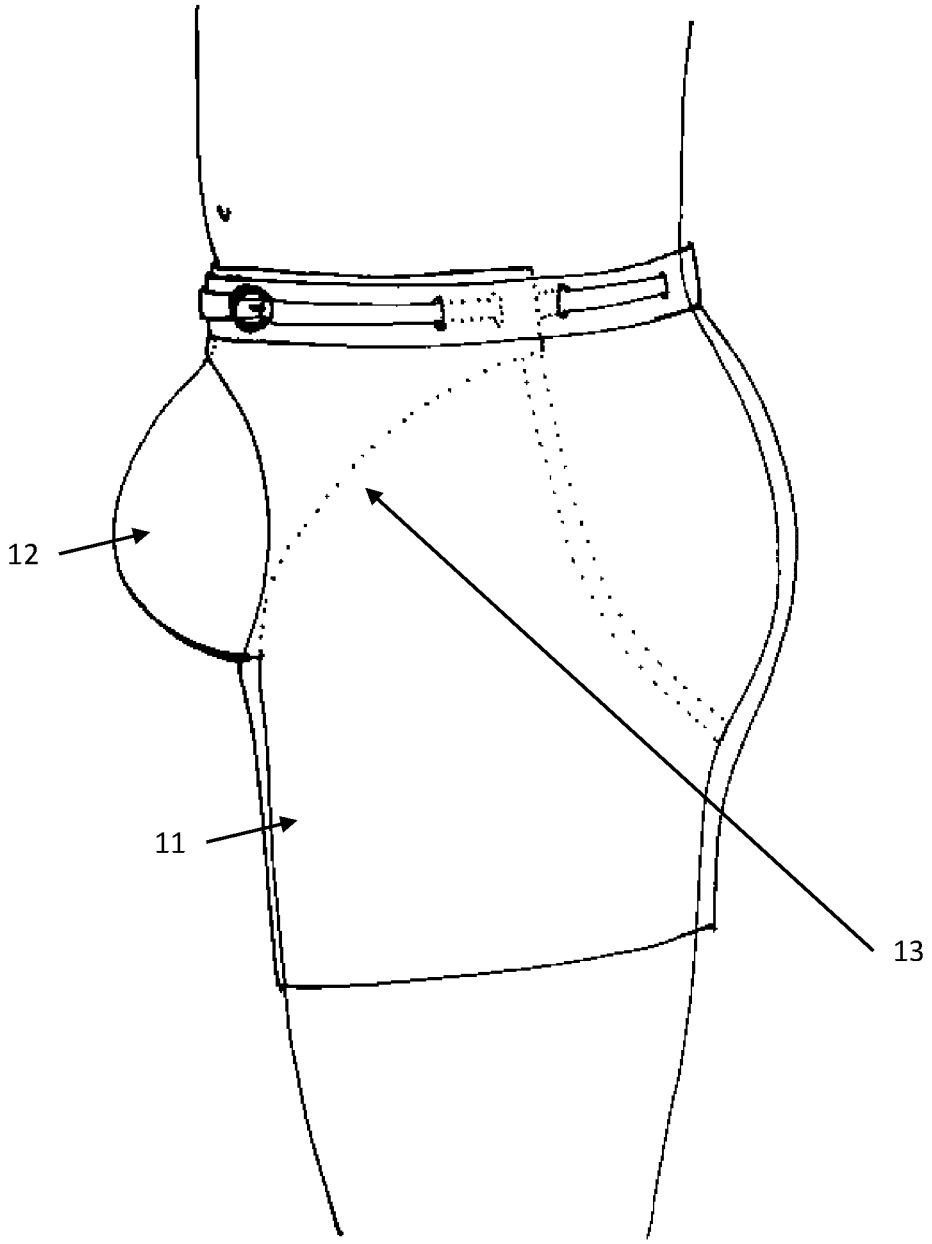
FIG. 4 is a side planar view of a first embodiment of the present invention as shown being worn.

FIG. 4 is a side planar view of a first embodiment of the present invention as shown being worn.

Figure 5:
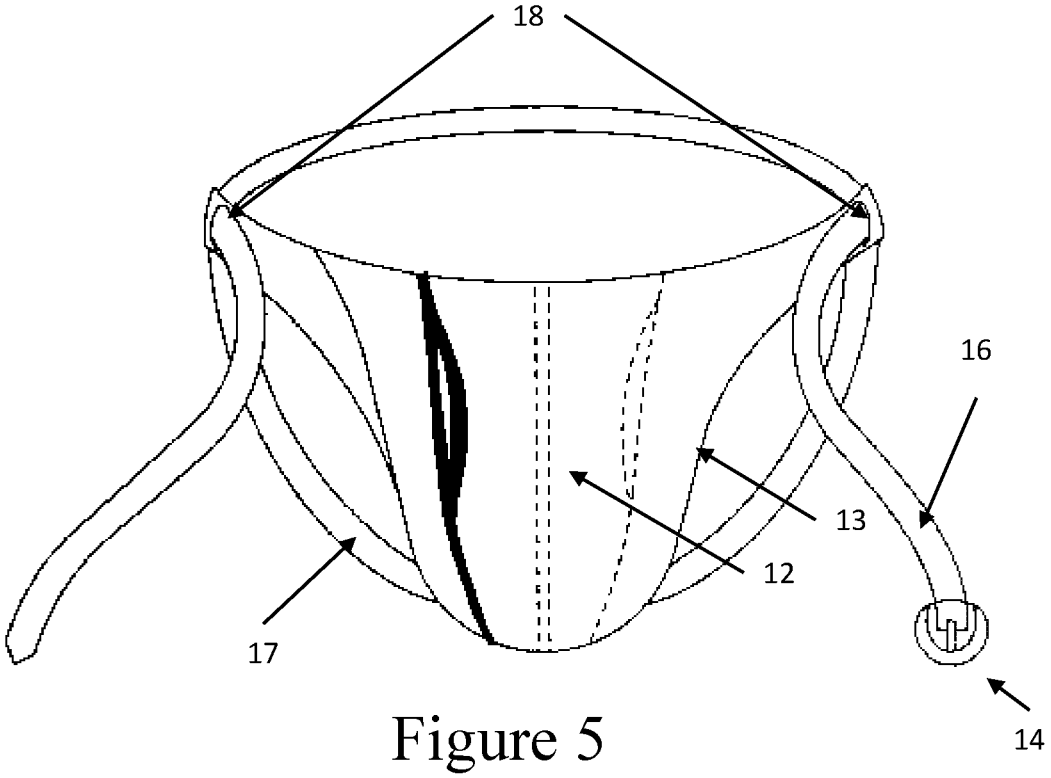
FIG. 5 is a front perspective view of the second, inner layer of a first embodiment of the present invention.
Figure 6:
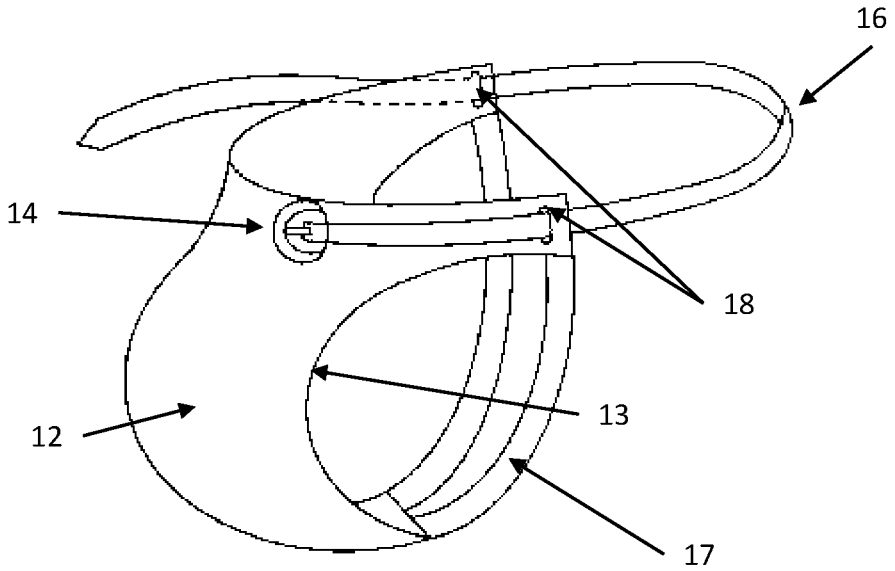
FIG. 6 is a side perspective view of the second, inner layer of a first embodiment of the present invention.

FIG. 5 is a front perspective view of the second, inner layer of a first embodiment of the present invention. FIG. 6 is a side perspective view of the second, inner layer of a first embodiment of the present invention.

As shown in FIGS. 5-6, the second, inner layer 12 is comprised of a front area creating a pouch 12 portion, and in this jockstrap embodiment, two straps 17 extend from the end of 12 and under holes 18 to the lowest or furthest portion of the pouch 12, creating straps 17 which go around a wearer's legs. The pouch or the second, inner layer 12, in this embodiment, is comprised of two opposing holes 18 at each end, which the belt 16 can pass through.

The belt 16 creates a loop to go around a wearer's waist and is attached to the waist band 10 of the first, outer layer 11.

Figure 7:
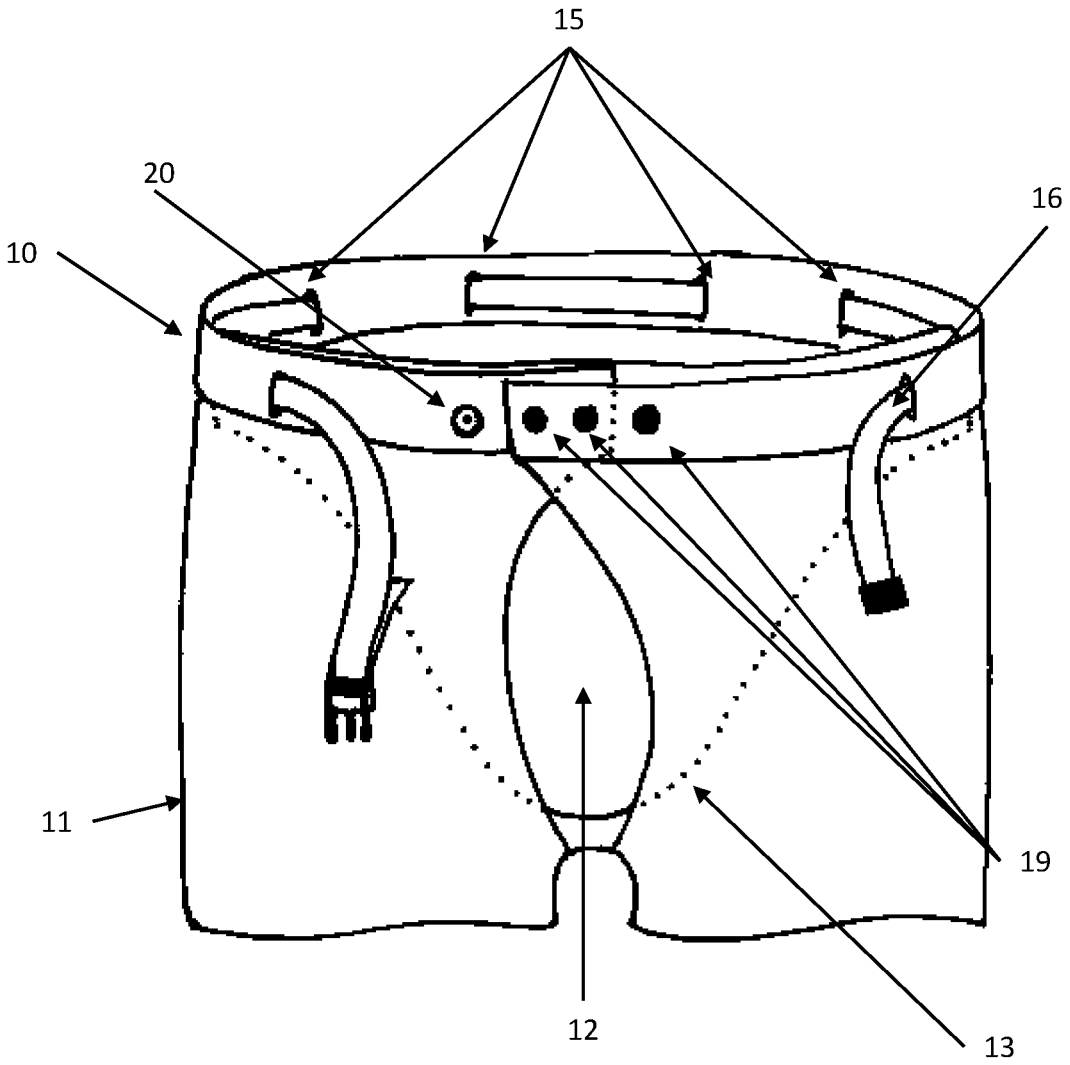
FIG. 7 is a front planar view of a first embodiment of the present invention in a buttoned and unbuckled position looking through the first, outer layer and highlighting the second, inner layer featuring buttons providing size adjustment for the first, outer layer.

FIG. 7 is demonstrating three sizes for the waist: The actual size the middle button (for example size L) and one size smaller (in this example: size M) and one larger (in this example: size XL) leaving the pouch and its measurement separate all together.

Figure 8:
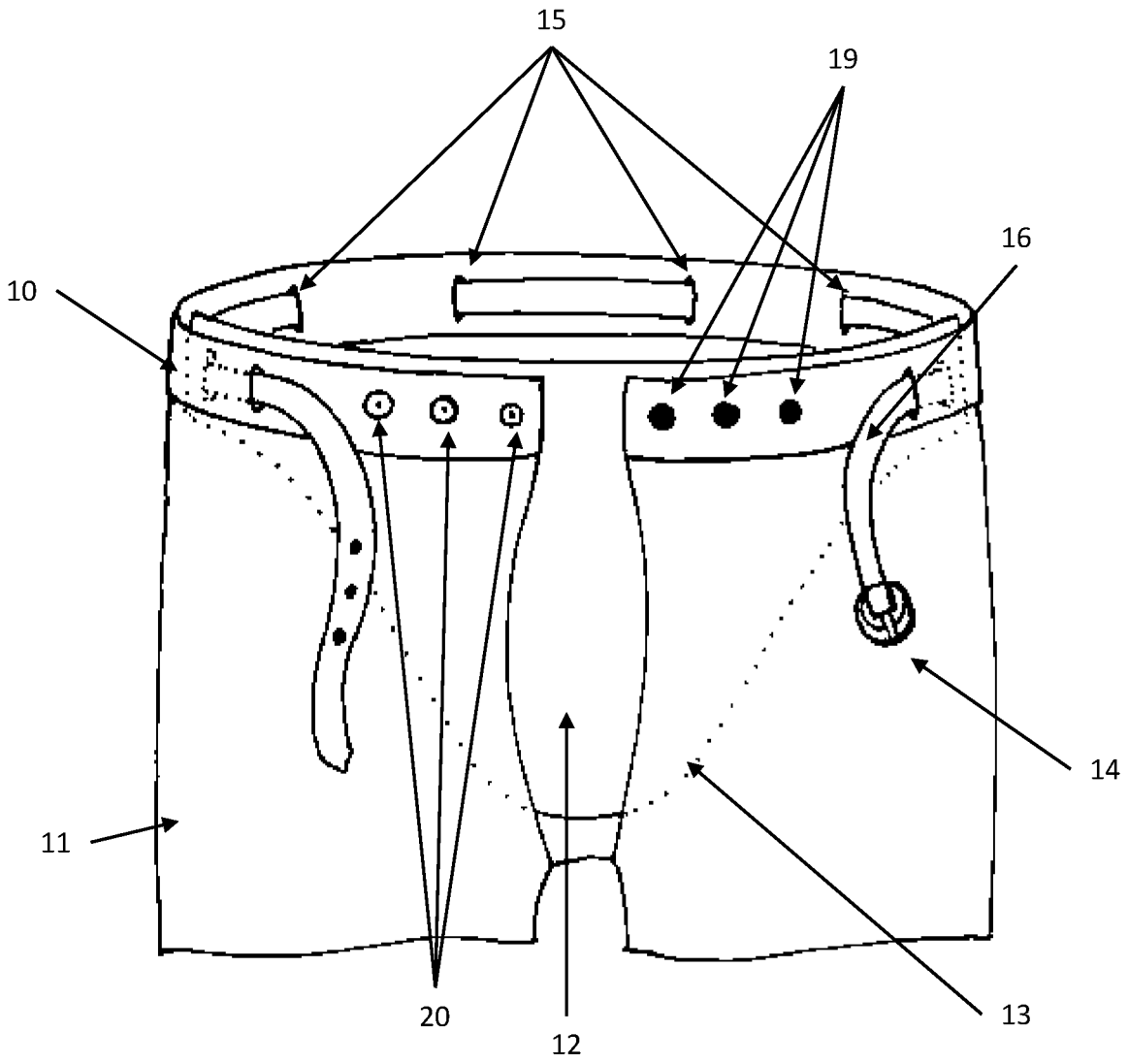
FIG. 8 is a front planar view of a first embodiment of the present invention in an unbuttoned and unbuckled looking through the first, featuring buttons providing size adjustment for the first, outer layer and outer layer and highlighting the second, inner layer, featuring the belt providing size adjustment for the second, inner layer.

FIG. 8 is a front perspective view of the first, outer layer 11 and second, inner layer 12, assembled and secured with three buttons consisting of a plurality of button bottoms 20 and corresponding button tops 19 (or any form of secure attachment) in accordance with the first embodiment of the present invention.

Figure 9:
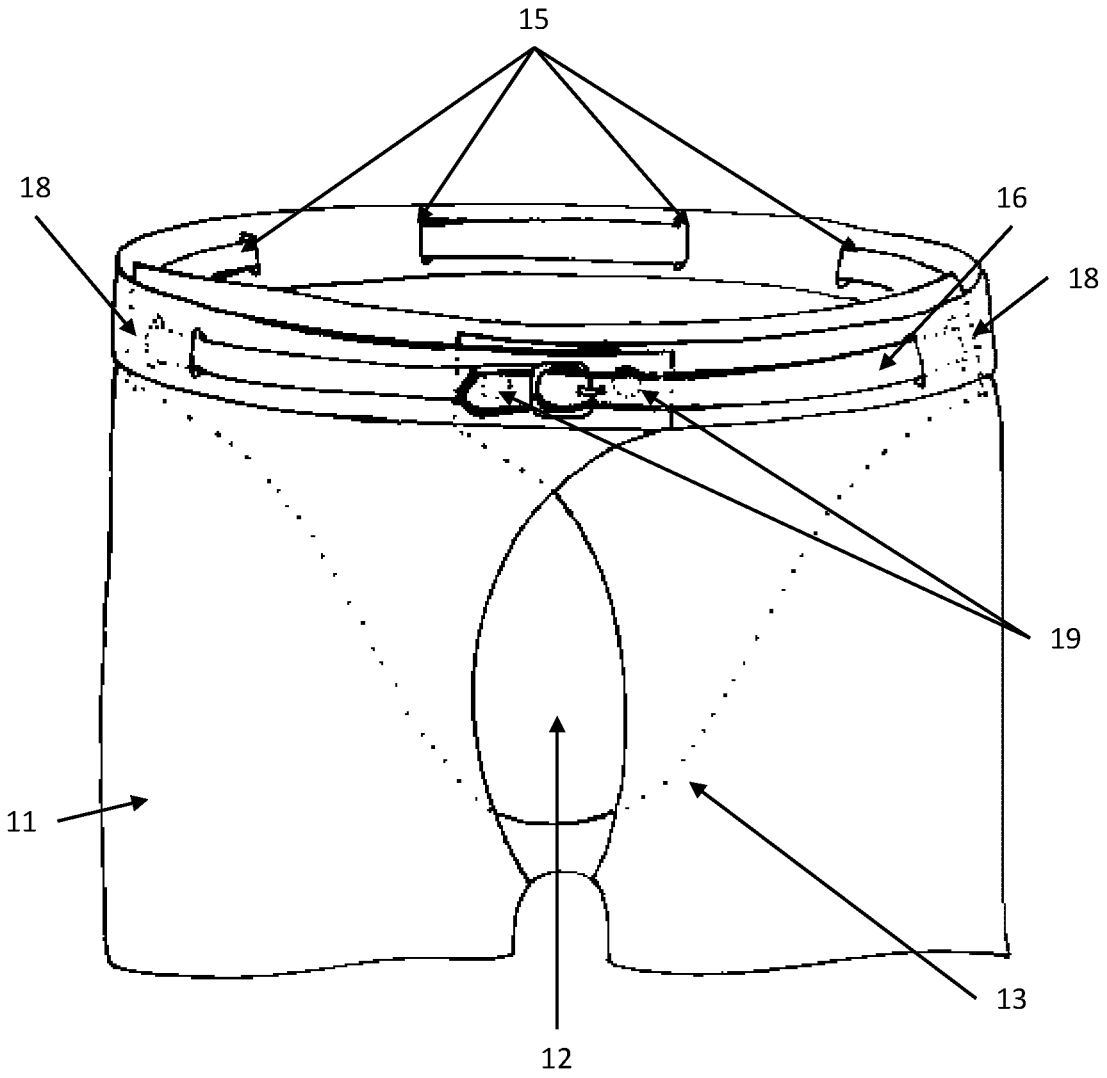
FIG. 9 is a front planar view of a first embodiment of the present invention in a buttoned and buckled position looking through the first, outer layer and highlighting the second, inner layer.

FIG. 9 is a front planar view of a first embodiment of the present invention in a buttoned and buckled position looking through the first, outer layer and highlighting the second, inner layer.

With respect to FIGS. 8 and 9, an embodiment of the present invention is illustrated where a first, outer layer 11 has a plurality of button bottoms 20 and button tops 19 on the waist band 10 for adjusting the size of the first, outer layer 10, along with the second, inner layer 12 at the same time, through pulling the belt 16 and selecting the desire waist band size, up or down one size, enabling three size configurations for the first, outer layer. A belt 16 is used to adjust the sizes as well as attaching the first, outer layer 11 to a second, inner layer 12 which creates a front pouch in the open area of the first, outer layer 11 as defined by the flaps 13 of the second, inner layer 13.

Figure 10:
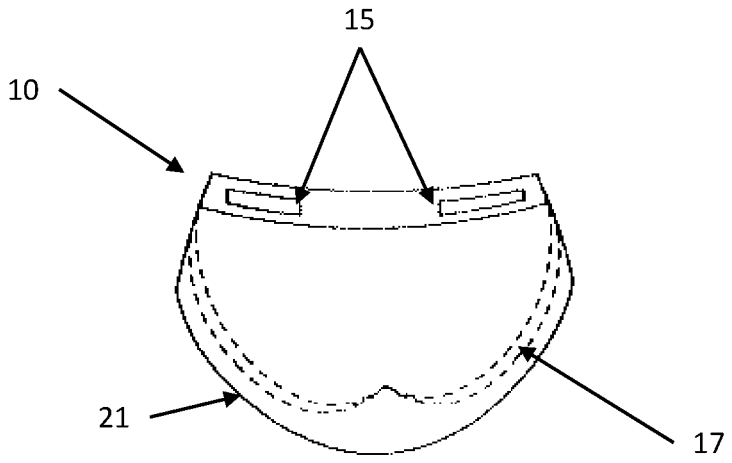
FIG. 10 is a rear planar view of a second embodiment of the present invention, comprising a brief underwear, looking through the first, outer layer and highlighting the second, inner layer.

FIG. 10 is a rear planar view of the present invention in a brief underwear version, second embodiment, looking through the first, outer layer 21 and highlighting the second, inner layer 12.

FIG. 11 is a front planar view of the present invention in a brief underwear version, second embodiment, looking through the first, outer layer 21 and highlighting the second, inner layer 12.

As shown in all Figs, here the outer, first layer 11 and/or 21 is shown on a wearer with solid lines. Dashed or broken lines are used to show the second, inner layer 12 where the front portion creates the pouch 12.

In FIGS. 11—12, straps 22 are attached to the first, outer layer 21 in order to retain the first, outer layer 21 in place on a wearer, while straps 17 in FIG. 12 are attached to the second, inner layer 12 to retain the second, inner layer 12 in place, while the first, outer layer straps 22 and the second, inner layer straps 17 are completely separate. Straps 22 are attached in the waistband area where the first, outer layer 21 and straps 17 are attached to the second, inner layer 12.

The Inventor has undertaken a large amount of research and development with respect to the present invention, which provides rebuttal to any potential obviousness or design choice matters. The Inventor ran multiple tests on focus groups which indicate that the present invention resolves the above problems as follows:

With respect to the sizing issue, there are no products invented to separate crotch from the rest of the body that allow the consumer to select the items based on a breakdown of the "sizing" into the different areas of the body (waist, hip, crotch, and thigh). The present invention provides consumers with the possibility of selecting one underwear that would match their unique sizes in all the different areas of waist, hips, crotch, and thighs. It Makes custom combination sizing possible, so that we can provide to consumers their exact sizes for waistband, hip, pouch, and thigh, without having them suffer or sacrifice on other measurement areas by fitting them only on waistband.

With respect to the Bouncing and zero support, male reproductive organs bounce by walking, running and other activities or movements, while they have a very sensitive skin and anatomy. The second layer of the present invention provides support and keeps the package in place, resulting in zero bouncing.

With respect to the Riding up issue, this is a very highly rated problem. When the user walks or makes different movements, while working, etc. because almost all global underwear productions are based on one-size-fits-all mentality and a predetermined size chart (above), a large percentage of the population are suffering from this issue the most. Such as athletes, runners, cyclers, etc., because their thighs and hips are much bigger than normal, causing ride-up, as well as those that genetically have a bigger hips, pouch, and thighs, such as African Americans.

Separating pouches from the other areas mentioned above (inner layer), plus the completely open area in the front of the outer layer, allows for maximum movements and activity without riding up. Because of this opening, the thigh muscles won't need to borrow more room and pull the fabric up, during exercise or other movements where they get larger. Instead, the open area gets pulled and easily opens, without riding the fabric on the thighs.

With respect to the Rubbing or Chaffing issue in the current underwear in the global market, the sensitive skin of the R-organs and the sides of the thighs, rubbing each other 'skins, as there is no fabric around the former to keep the skin separate from skin of the thighs, creating extreme discomfort, embarrassment in public, and skin conditions such as friction, skin chafing, redness, rashes, and itching.

Because the fabric between R-organs and thighs is in place, there is zero rubbing. Therefore, all skin problems, etc., are resolved.

With respect to the heating up and sweating issue creating discomfort, wet areas on the outfit, and rubbing and itching, etc., which makes rubbing even worse! Since current underwear pairs are one piece and have no, or very little, ventilation. Secondly, there are no fabrics around the R-organs to take the moisture off and prevent it from reaching to the pants, which causes another embarrassment issue.

The front opening area provides the maximum air movement, ventilation, and cooling system possible, which is a completely new invention and has never been done before. The jockstrap has two layers (with or without a fly). The inner layer is made of microfiber, antimicrobial mesh with a maximum moisture observant and dries faster than any other underwear, because, again, it is directly ventilated.

With respect to pinching, because of the lack of having a fixed-cover around the R-organ, it gets pinched by movements and pulling the pubic hair in that area.

The fixed and in place fabric around R-organs, protects the skin as well as pubic hair to be pulled and get pinched.

With respect to drops of urination, current underwear in the global market is made of one or two layers of fabric, so drops remaining after urination easily reach the outdoor pants before drying and show; another embarrassing issue.

Because of the opening area and ventilation system, they will dry before reaching to the pants. In addition to the plurality of layers in the underwear of the present invention, drops will be absorbed before they pass. The inner layer touching the skin is made of mesh antimicrobial.

With respect to male fertility, some underwear producers make R-organs sections tight intending to put it in place and reducing movements and bouncing that are naturally happens in this organ. However, this negatively affects male fertility due to tightness in that area.

In the present invention, the crotch area has enough room, while having great support.

With respect to waistband impressions, because the user is trying to match his body with the sizes available in the market, he has to select the best possible match and live with the issue of not being able to find the correct size.

With respect to the present invention, the consumer is able to select their unique size. This is because the invention consists of two pieces, thus able to match and combine the sizes easier. Again, there is no need to sacrifice and suffer in one part of the body, in order to have comfort in another part. Consumers can select their unique sizes for all parts.

With respect to the issue of underwear lines, because the current underwear pairs are in one piece and fixed on the hip and pouch areas, when the consumer sits down, fabric travels up between their hips, and when the stands up, the fabric stays there, requiring adjustments.

Because of the opening in the front in the crotch area, the large areas such as the crotch, hips or even thighs won't pull the fabric up between the hips.

The present invention teaches the novel and non-obvious use of a two-layer men's underwear garment that allows to provide functionally comfortable underwear for any custom and unique size and create the desired fit for a wide range of male sizes.

Furthermore, while the invention teaches the use of a belt and of a seamless waist band, different waist band designs can be utilized and the invention should not be limited to one specific means of attachment of the first and second layers, as although a belt is taught, snaps, buttons, or other attachments could be used.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

Therefore, the foregoing is considered as illustrative only of the principles of the present invention. Further, since numerous modifications and changes will readily occur to those skilled in the art, it is not desired to limit the present invention to the exact construction and operation shown and described, and accordingly, all suitable modifications and equivalents are resorted to, falling within the scope of the present invention.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

Therefore, the foregoing is considered as illustrative only of the principles of the present invention. Further, since numerous modifications and changes will readily occur to those skilled in the art, it is not desired to limit the present invention to the exact construction and operation shown and described, and accordingly, all suitable modifications and equivalents are resorted to, falling within the scope of the present invention.

The embodiments of the present invention in which an exclusive property or privilege is claimed are defined as follows:

1. An underwear garment, comprising:

a first, outer layer;

the first, outer layer having a waistband;

the waistband having one or more holes for retaining a belt;

a second, inner layer;

the second, inner layer having a pouch area, one or more straps, a plurality of opposing holes where the straps and an upper pouch area meet for connecting to a belt; and wherein the first, outer layer is attached to the second, inner layer using a belt passing through the opposing holes of the second, inner layer;

wherein the second, inner layer is comprised of:

a front area creating a pouch portion, one or two straps extend from the waistband to a lower or furthest portion of the pouch from the belt or waistband;

the belt creates a loop configured to go around a wearer's waist and is attached to the waistband of the first, outer layer;

the pouch is comprised of two opposing holes of the plurality of the opposing holes at one end though which the belt can pass through; and from the holes, straps extend to the opposing end of the pouch, creating straps configured to go around a wearer's legs;

wherein the second, inner layer is any type of underwear such as a jockstrap or thong; the cut, shape, or design of the second, inner layer can be of any shape as long as the decoupling or separation provided by the pattern/cut is retained; and the second, inner layer creates the front pouch as defined by the cut/shape, which is separated or decoupled from the first, outer layer and its flaps which create an opening or access area where the pouch of the second, inner layer is located;

the second, inner layer is shaped in a thong cut; the second inner layer has a frontal pouch area extending from a top, waistband or belt location to a lower meeting point; and a single strap extends from the lower meeting point to the waistband or belt location that is in direct opposition to the top front pouch area.

2. The underwear garment of claim 1, wherein the first layer covers the waist, hips, and thighs; the second layer creates the pouch; and the layers are decoupled and isolated from each other except at the waistband.

3. The underwear garment of claim 1, wherein the outer layer has the waistband; the second, inner layer is detachable from the waistband; and the engagements between the thighs, hips, and pouch are removed all together.

4. The underwear garment system of claim 1, wherein the pouch area of the first layer is not enclosed and has no front pouch portion, it is open completely, thereby creating said full opening flaps in the front of the underwear; the first, outer layer features the full opening flaps extending from a middle of the front of the waistband, positioned directly over the pouch portion of the second, inner layer, thereby facilitating accessibility to the second, inner layer.

5. The underwear garment of claim 1, wherein the belt is used to provide an adjustable waistband in the present invention and as a means to connect the first, outer layer to the second, inner layer.

6. The underwear garment of claim 1, wherein the second, inner layer is attached to the first, outer layer via the belt; the outer layer configured to fit a wearer like boxer briefs, briefs, but has no front pouch; and the second, inner layer provides the pouch area, which is decoupled or separated from the outer layer as the only attachment location is the waistband of the outer layer with the belt and the holes of the pouch section of the inner layer.

7. The underwear garment of claim 1, wherein the consumer is able to select their unique size; and the consumer is able to match and combine different sizes of first, outer layers, and second, inner layers to match their unique size requirements for each of the two layers to their body.

8. The underwear garment of claim 7, wherein the men's underwear garment that allows for the mixing and matching of sizes to create the desired fit for a wide range of male shapes and sizes.

9. The underwear garment of claim 8, wherein combinations of sizes ranging from extra small, small, medium, large, and any number of extra-large sizes are created and offered with respect to both the outer layer and inner layer.

10. The underwear garment of claim 1, further comprising one or more buttons on the waistband for adjusting the side of the first, outer layer.

11. The underwear garment of claim 10, wherein three buttons are provided on the waistband for adjusting the size of the first, outer layer.

12. The underwear garment of claim 11, wherein the three buttons allow for the adjustment of the first, outer layer between a first smaller size, a second middle size, and a third, larger size.

* * * * *